US006487771B1

(12) United States Patent
Lin

(10) Patent No.: US 6,487,771 B1
(45) Date of Patent: Dec. 3, 2002

(54) METHOD FOR MANUFACTURING SPEAKER BOTTOM YOKE

(76) Inventor: Hui Chiu Lin, No. 4, Lane 234, Hsin Shu Rd., Hsin Tsuang, Taipei Hsien (TW)

( * ) Notice: Subject to any disclaimer, the term of this patent is extended or adjusted under 35 U.S.C. 154(b) by 0 days.

(21) Appl. No.: 09/566,997

(22) Filed: May 9, 2000

(51) Int. Cl.[7] ..... H01F 7/06

(52) U.S. Cl. ..... 29/607; 29/594; 29/609.1; 29/592.1; 29/893.34; 381/398; 381/405

(58) Field of Search ..... 29/607, 594, 609.1, 29/602.1, 893.34, 592.1; 381/398, 405, 407; 419/29, 28; 148/667, 226

(56) References Cited

U.S. PATENT DOCUMENTS

| | | | | | |
|---|---|---|---|---|---|
| 4,059,214 | A | * | 11/1977 | Weissman | 228/265 |
| 4,289,937 | A | * | 9/1981 | Ikeda et al. | 29/607 |
| 4,759,117 | A | * | 7/1988 | Kato | 29/598 |
| 4,942,796 | A | * | 7/1990 | Dom et al. | 83/72 |
| 5,099,949 | A | * | 3/1992 | Mitobe | 181/171 |
| 5,157,731 | A | * | 10/1992 | Mitobe | 381/202 |
| 5,270,676 | A | * | 12/1993 | Mitobe et al. | 335/231 |
| 5,409,555 | A | * | 4/1995 | Fujita et al. | 148/667 |
| 5,902,424 | A | * | 5/1999 | Fujita et al. | 148/667 |
| 5,940,522 | A | * | 8/1999 | Cahill et al. | 381/397 |
| 5,985,044 | A | * | 11/1999 | Hurita et al. | 148/226 |
| 6,289,106 | B1 | * | 9/2001 | Wong | 381/405 |

FOREIGN PATENT DOCUMENTS

| | | | | |
|---|---|---|---|---|
| DE | 3925370 A | * | 8/1988 | |
| JP | 52035622 A | * | 3/1977 | 29/505 |
| JP | 56-168498 | * | 12/1981 | |
| JP | 04354299 A | * | 12/1992 | 381/412 |
| JP | 05161189 A | * | 6/1993 | 381/357 |

* cited by examiner

*Primary Examiner*—Peter Vo
*Assistant Examiner*—Minh Trinh
(74) *Attorney, Agent, or Firm*—Varndell & Varndell, PLLC

(57) ABSTRACT

Method for manufacturing speaker bottom yoke, including steps of: 1. calculating product weight according to required dimension; 2. cutting off a blank material with the calculated weight from steel bar (material bar), which blank material can be further planed; 3. performing first time forging to forge one end of the blank material into a stem section with reduced diameter, which stem section can be formed with a sink in accordance with the required shape of the bottom yoke; 4. performing second time forging to forge the other end of the blank material into a bottom disc with larger diameter; and 5. performing third time forging to further forge the bottom disc of the blank material into a predetermined dimension. In the above forging procedure, the diameter of the blank material is forged from large dimension into small dimension and the bottom disc is forged at two times into a specific dimension. Therefore, the blank material will not have too high density over the forging ratio and thus the annealing operation is unnecessary.

8 Claims, 5 Drawing Sheets

METHOD FOR MANUFACTURING SPEAKER BOTTOM YOKE

BACKGROUND OF THE INVENTION

The present invention relates to a method for manufacturing speaker bottom yoke, which shortens the manufacturing time, increases production capacity, enhances product quality and beautifies the appearance of the product. This method is especially applicable to the base seat of a speaker.

As shown in FIG. 5, a conventional speaker bottom yoke is made of an iron bar blank material A with smaller diameter. The iron bar blank material A is first punched into a bottle shape B. Then the blank material is secondarily punched to expand the head end thereof into a mushroom head shape C. At this time, the iron bar blank material with mushroom head end has almost reached the forging ratio of the material. Therefore, for further forging the material into the necessary bottom yoke with specific dimension, it is necessary to anneal the material. Otherwise, the material will be torn apart. In the annealing procedure of metal material, it is necessary to remove the iron bar blank material A from the punching mold. After the annealing procedure, the iron bar blank material A is again put back into the mold for further processing. The above conventional annealing procedure includes multiple complicated steps such as skin removing and sand spraying. After the annealed semi-product is again placed into the punching mold cavity, some shortcomings may take place, such as inaccurate mating and prolonged manufacturing time.

The mushroom head end must be processed into a suitable thickness as necessary. The body of the bottom yoke is continuously punched and forged into a necessary precision of dimension to form a bottom yoke specifically for speaker.

During the manufacturing procedure of the bottom yoke, the large-sized bottom disc is forged in such a manner that the small diameter iron bar is continuously pressed to form a large-sized bottom disc. Therefore, the density of the iron bar is changed from low density into compact density. Therefore, after this step, an annealing step is required to soften the tissue of the iron bar and then the successive manufacturing step can be performed. In case the annealing step is omitted and the too dense iron bar blank material is further forged, the forging mold is very likely to damage. Also, in case the forging ratio of the product has is too high, the material may be torn apart to form defective product. Therefore, it is necessary to first anneal the material and remove the iron bar blank material from the mold. After annealed, the material is again moved back into the mold for further forging. Such procedure is quite time-consuming and laborious. As a result, the manufacturing time is prolonged and the production capacity is reduced and thus the cost for labor is increased. In this field, the production efficiency of working time occupies almost 30~40% of the manufacturing cost.

SUMMARY OF THE INVENTION

It is therefore a primary object of the present invention to provide a method for manufacturing speaker bottom yoke, by which the operation is unified and the annealing step is unnecessary and it is unnecessary to remove the forged blank material from the mold. This method shortens the manufacturing time and increases production capacity.

It is a further object of the present invention to provide the above manufacturing method by which the appearance of the speaker bottom yoke is beautified.

According to the above objects, the method for manufacturing speaker bottom yoke of the present invention includes steps of: 1. calculating product weight according to required dimension; 2. cutting off a blank material with the calculated weight from steel bar (material bar), which blank material can be further planed; 3. performing first time forging to forge one end of the blank material into a stem section with reduced diameter, which stem section can be simultaneously formed with a sink in accordance with the required shape and dimension of the bottom yoke; 4. performing second time forging to forge the other end of the blank material into a bottom disc with larger diameter; and 5. performing third time forging to further forge the bottom disc of the blank material into a predetermined dimension.

In the above forging procedure, the diameter of the blank material is forged from large dimension into small dimension and the bottom disc is forged at two times into a specific dimension. Therefore, the blank material will not have too high density over the forging ratio and thus the annealing operation is unnecessary. Therefore, it is unnecessary to remove the blank material from the mold and the operation can be unified to shorten the manufacturing time and mass-produce the products.

The present invention can be best understood through the following description and accompanying drawings wherein:

DETAILED DESCRIPTION OF THE PREFERRED EMBODIMENT

It is known that in forging processing, a metal material is placed between two molds which press the metal material to shorten the height of a part of or entire material, while increase the width thereof so as to form a desired shape. This measure also is able to improve the mechanical properties of the material.

In general, the metal material used in the forging procedure pertains to polycrystalline metal. Such metal is cast to form coarse tree-like crystal which has internal defects such as shrinkage cavity, shrinkage hole and segregation. Therefore, such material lacks stiffness and safety. When pressing and molding the metal material, not only the coarse tree-like crystal of the material is mechanically damaged, but also re-crystallization will take place to fine the material and eliminate the shrinkage cavity and shrinkage hole. Also, the local segregation can be evenly distributed.

By means of forging, the material can be shaped as desired without losing the material and processing time resulted from mechanical processing. Also, the flow deformation of the material will lead to enhanced orientation of the forging flux and mechanical properties of the material. Especially, an apparent increment of impact value in the forging flux direction can be seen. It is clear from the above that forging operation provides considerable enhancing effect for tension strength, shrinkage ratio of extending cross-section and impact value.

Figure 1:
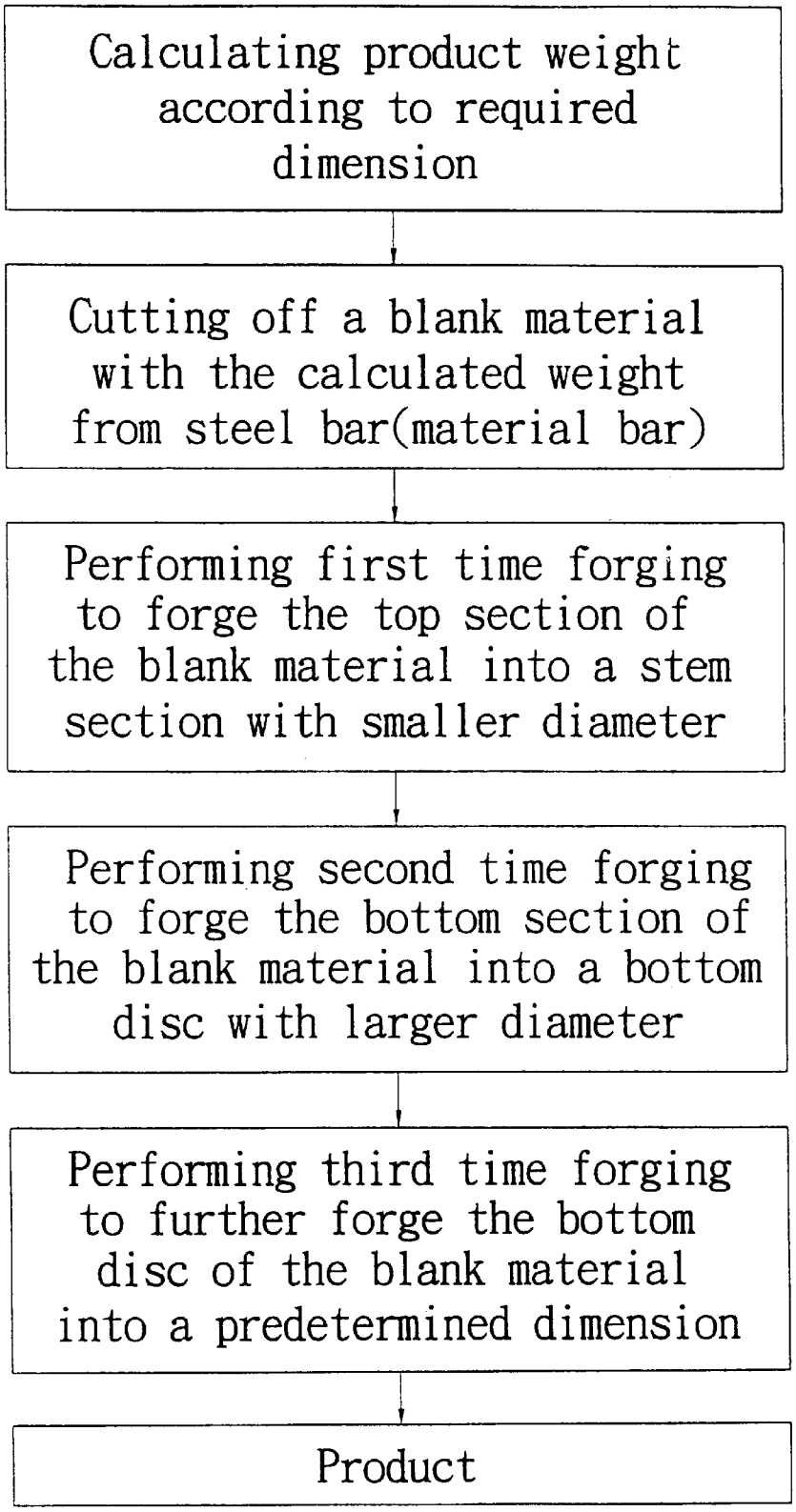
FIG. 1 is a block manufacturing flow chart of the present invention.

Please refer to FIG. 1. The method of the present invention includes the steps of:

1. calculating product weight according to required dimension;
2. cutting off a blank material with the calculated weight from steel bar (material bar), which blank material can be further planed;
3. performing first time forging to forge one end of the blank material into a stem section with reduced diameter, the stem section being formed with a sink (which can be omitted in accordance with actual situation);
4. performing second time forging to forge the other end of the blank material into a bottom disc with larger diameter; and
5. performing third time forging to further forge the bottom disc of the blank material into a predetermined dimension to achieve a product.

Figure 2:
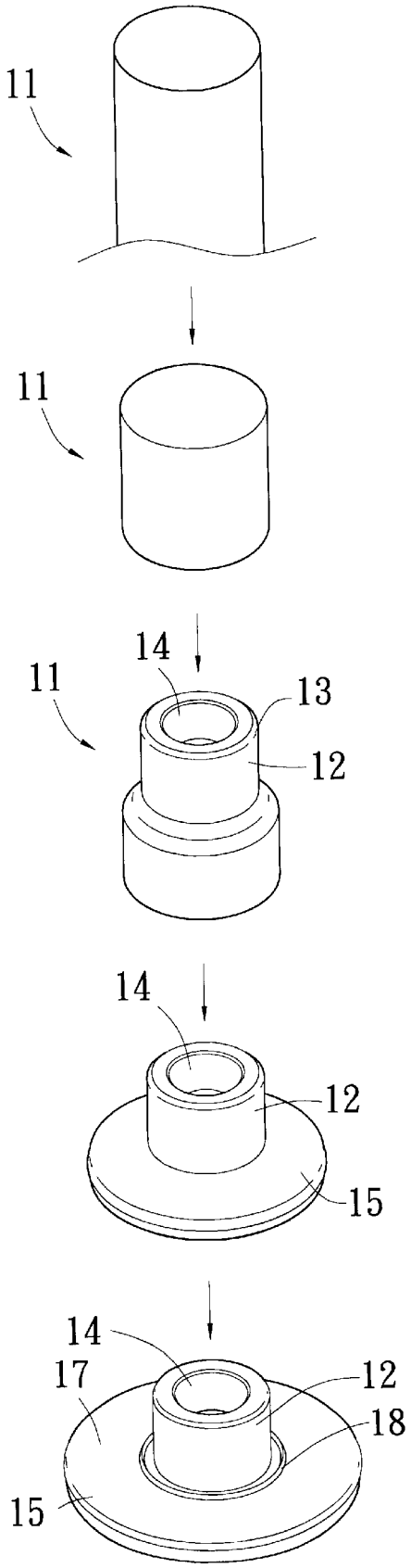
FIG. 2 is a real manufacturing flow chart of the present invention.
Figure 3A:
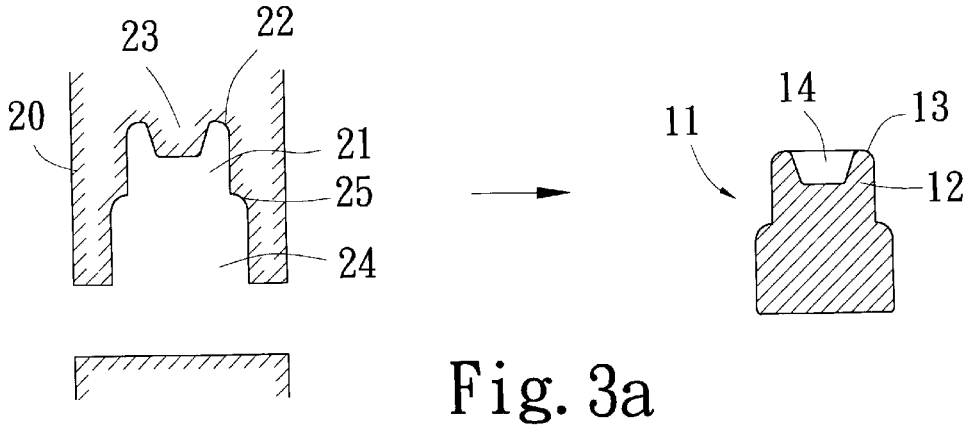
FIGS. 3*a*–3*c* are cross-reference sectional views of the molds and real products of the present invention.
Figure 3B:
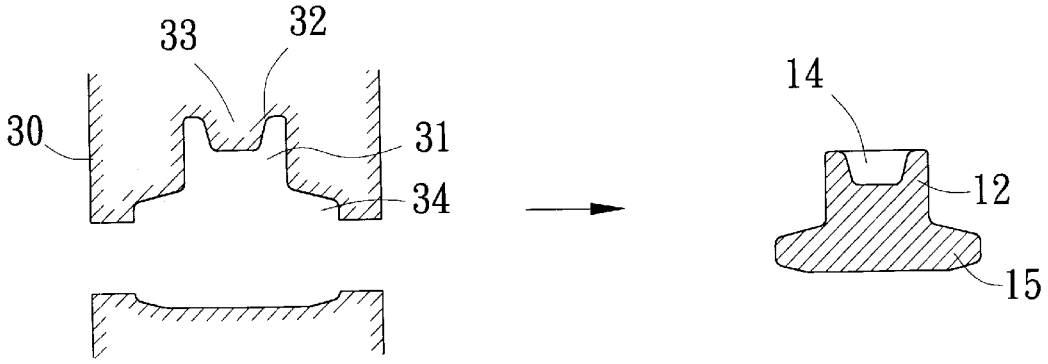
Figure 3C:
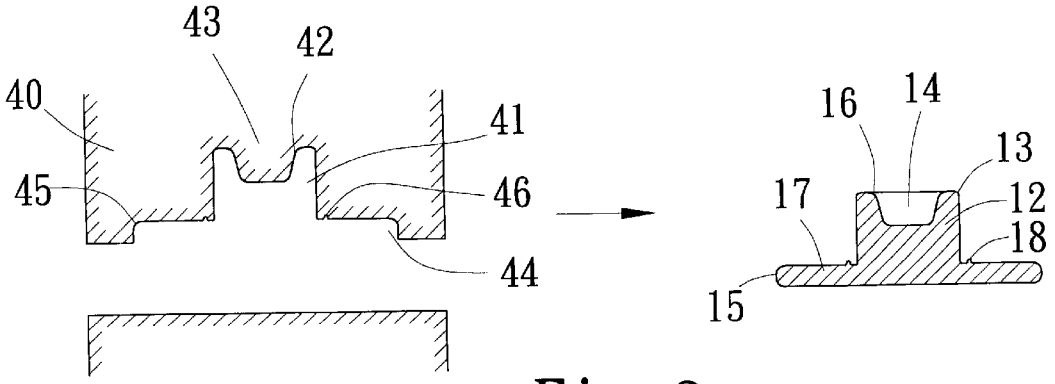

According to the above, the weight of the product with desired dimension is first calculated. Weight=density× volume. The volume of the cylindrical steel bar=area ($\pi r^2$) ×length. As shown in FIG. 2, a steel bar 10 with a desired diameter is selected. The density of the steel bar is introduced to obtain the length L to be cut off. The cut off blank material 11 with specific length and weight is then processed. (It is previously planed prior to formal forging). Referring to FIGS. 3*a* to 3*c,* first the blank material 11 is placed into a first mold 20 having a first and a second sinks with two stages of diameters. The bottom edge of the first sink 21 is formed with guide angle 22 and the center thereof is formed with a boss section 23 which is formed, depending on the requirement of the product. The depth of the first sink 21 is determined by the dimension of the product. The second sink 24 adjoins the first sink 21 at an arch edge 25. When pressed, the diameter of the upper half of the blank material 11 is reduced, while the height thereof is increased to form a small diameter stem section 12. The center of the top face of the stem section 12 is downward recessed to form a sink 14 (which is formed in accordance with the appearance and profile of the actual product and is omissible). The edge of the sink 14 is formed with guide angle 13. In addition, the stem section 12 adjoins the bottom blank material 11 at an arch edge. Then the blank material is placed into a second mold 30.

The second mold 30 is similar to the first mold 20 and formed with a first and a second sinks 31, 34 having two stages of diameters. The center of the first sink 31 is formed with a boss section 33. The bottom edge of the boss section 33 is formed with a guide angle 32. The diameter of the second sink 34 is larger than the diameter of the second sink 24 of the first mold 20. The second sink 34 adjoins the first sink 31 at an inclined face. After the blank material 11 is pressed by the second mold 30, the stem section 12 remains the same as the profile after pressed by the first mold 20, while the bottom of the blank material 11 is formed as a bottom disc 15 with inclined face and larger area.

Figure 4:
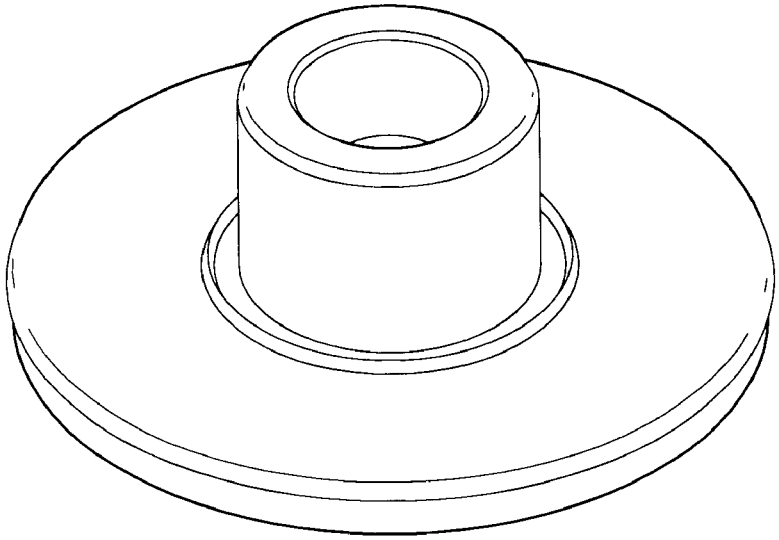
FIG. 4 is a perspective view of a real product of the present invention.
Figure 5:
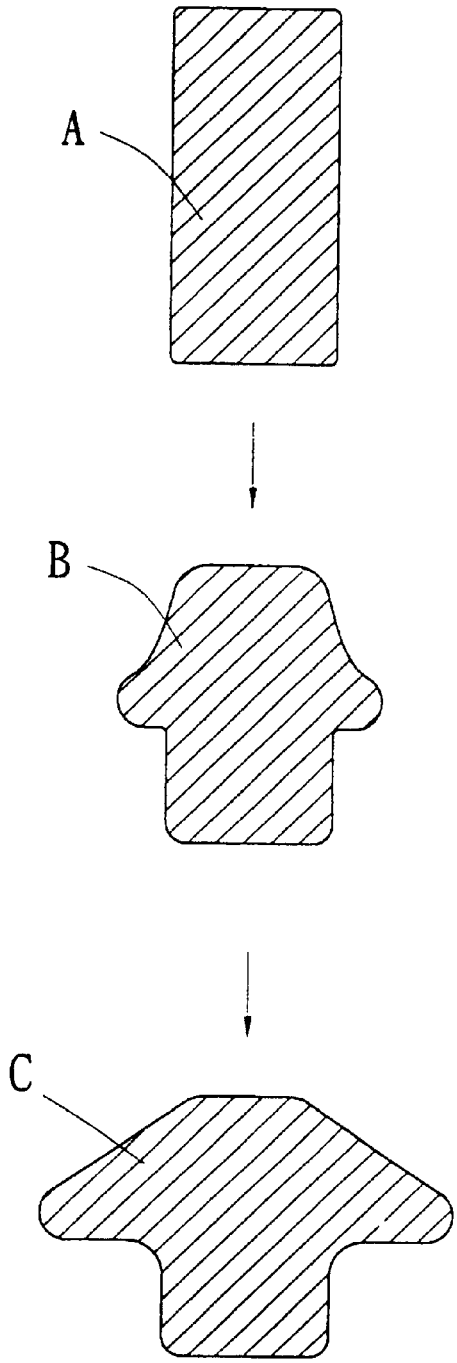
Fig. 5 (PRIOR ART)
FIG. 5 shows the preceding forging operation of a conventional bottom yoke.

Then the blank material is placed into a third mold 40. The third mold 40 is similar to the first mold 20 and second mold 30 and formed with a first and a second sinks 41, 44 having two stages of diameters. The center of the first sink 41 is formed with a boss section 43. The bottom edge of the boss section 43 is formed with a guide angle 42. The diameter of the second sink 44 is specifically sized in accordance with the requirement. A part of the second sink 44 adjacent to the first sink 41 is formed with an annular groove 46 (which can be omitted as necessary). The inner corner of the second sink 44 is formed with a guide angle 45. The second sink 44 adjoins the first sink 41 at a plane face. After the blank material 11 is pressed by the third mold 40, the bottom disc 15 of the blank material 11 is forged into a desired dimension. A portion of the bottom disc 15 adjacent to the stem section 12 is formed with an annular rib 18. The circumference of the bottom disc 15, the top edge of the stem section 12 and the top edge of the sink 14 are all compressed to form arch guide angles 17, 13 and 16. Accordingly, a bottom yoke specifically for a speaker is formed as shown in FIG. 4.

According to the above arrangement, the present invention has the following advantages:

1. In forging procedure, the diameter of the blank material is forged from large dimension into small dimension and the bottom disc is forged at two times into a specific dimension. Therefore, the blank material will not have too high density and the annealing operation is unnecessary. Therefore, it is unnecessary to remove the blank material from the mold and the operation can be unified to shorten the manufacturing time and mass-produce the products.
2. The manufacturing procedure is unified and the blank material is unnecessary to be removed so that the labor is saved and the manufacturing cost is lowered.
3. The metal material is forged and pressed in accordance with the physical properties of the metal material. Therefore, the material loss and processing time due to mechanical processing can be saved. More importantly, the forge flux caused by the flow deformation of the material can beautify the appearance of the product.

The above embodiment is only used to illustrate the present invention, not intended to limit the scope thereof. Many modifications of the above embodiment can be made without departing from the spirit of the present invention.

What is claimed is:

1. A method for manufacturing a speaker bottom yoke, which comprises steps of:

calculating a product weight for the speaker bottom yoke based on desired dimensions;

cutting off a bottom yoke blank material with the calculated weight from a steel bar; and continuously performing multiple stages of forging to forge the bottom yoke blank material without annealing the bottom yoke blank material; the multiple stages of forging comprising a first forging stage, a second forging stage, and a third forging stage;

during the first forging stage, one end of the bottom yoke blank material is forged into a stem section with a reduced diameter;

during the second forging stage, another end of the bottom yoke blank material is forged into a bottom disc with larger diameter; and during the third forging stage, the bottom disc of the bottom yoke blank material is a further forged in to a predetermined dimension of the speaker bottom yoke.

2. The method for manufacturing a speaker bottom yoke as claimed in claim 1, wherein molds are used for the first, second and third forging stages, the molds have mold cavities, and the mold cavities respectively have two stages of different diameters.

3. The method for manufacturing a speaker bottom yoke as claimed in claim 1, wherein a head of the bottom yoke blank material is planed.

4. A method for manufacturing a speaker bottom yoke, comprising steps of:

calculating a product weight for the speaker bottom yoke based on desired dimensions;

cutting off a bottom yoke blank material with the calculated weight from a steel bar; and continuously performing multiple stages of forging to forge the bottom yoke blank material without annealing the bottom yoke blank material; the multiple stages of forging comprising a first forging stage, a second forging stage, and a third forging stage;

during the first forging stage, one end of the bottom yoke blank material is forged into a stem section with a reduced diameter;

during the second forging stage, another end of the bottom yoke blank material is forged into a bottom disc with larger diameter; and during the third forging stage, the bottom disc of the bottom yoke blank material is a further forged in to a predetermined dimension of the speaker bottom yoke;

wherein molds are used in the first, second and third forging stages, the molds respectively have first and second sinks with two stages of diameters, and a center of the first sink is formed with a boss section.

5. The method for manufacturing a speaker bottom yoke as claimed in claim 4, wherein a bottom edge of a boss section of the first sink of each of the molds for the first, second and third forging stages is formed with a guide angle.

6. The method for manufacturing a speaker bottom yoke as claimed in claim 4, wherein a diameter of the second sink of the mold for the third forging stage is larger than a diameter of the second sink of the mold for the first forging stage.

7. The method for manufacturing a speaker bottom yoke as claimed in claim 4, wherein a diameter of the second sink of the mold for the third forging stage is equal to a predetermined dimension of the speaker bottom yoke.

8. A method for manufacturing a speaker bottom yoke, comprising steps of:

calculating a product weight for the speaker bottom yoke based on desired dimensions;

cutting off a bottom yoke blank material with the calculated weight from a steel bar; and continuously performing multiple stages of forging to forge the bottom yoke blank material without annealing the bottom yoke blank material; the multiple stages of forging comprising a first forging stage, a second forging stage, and a third forging stage;

during the first forging stage, one end of the bottom yoke blank material is forged into a stem section having a reduced diameter and a sink;

during the second forging stage, another end of the bottom yoke blank material is forged into a bottom disc with larger diameter; and during the third forging stage, the bottom disc of the bottom yoke blank material is a further forged in to a predetermined dimension of the speaker bottom yoke.

* * * * *